US006393778B1

(12) United States Patent
Ting

(10) Patent No.: US 6,393,778 B1
(45) **Date of Patent: *May 28, 2002**

(54) AIRLOOP WINDOW SYSTEM

(76) Inventor: Raymond M. L. Ting, 318 Holiday Dr., Pittsburgh, PA (US) 15237

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/887,879

(22) Filed: Jul. 3, 1997

(51) Int. Cl.[7] ..... E06B 7/04

(52) U.S. Cl. ..... 52/204.5; 52/209; 52/204.51; 52/656.5; 52/656.6

(58) Field of Search ..... 49/504; 52/204.1, 52/204.5, 204.51, 207, 209, 656.2, 656.5, 656.6, 730.4, 734.1, 734.2, 204.591, 800.14

(56) References Cited

U.S. PATENT DOCUMENTS 3,859,754 A * 1/1975 Budich et al. ..... 49/504 X
4,040,219 A * 8/1977 Budich ..... 52/209
4,086,727 A * 5/1978 Kuyper et al.
4,229,905 A * 10/1980 Rush ..... 52/207 X
4,598,513 A * 7/1986 Gartner
4,704,839 A * 11/1987 Kay
4,819,405 A * 4/1989 Jackson ..... 52/209 X
4,821,475 A * 4/1989 Kondo et al. ..... 52/209 X
4,852,312 A * 8/1989 Harbom ..... 52/204.5 X
4,894,973 A * 1/1990 Over
4,949,506 A * 8/1990 Durham, Jr. ..... 52/204.51 X
4,958,468 A * 9/1990 Nolan ..... 52/204.51
5,325,579 A * 7/1994 Baier
5,452,552 A 9/1995 Ting
5,555,682 A * 9/1996 Colitto
5,596,851 A * 1/1997 Ting
5,598,671 A * 2/1997 Ting
5,687,524 A 11/1997 Ting
5,768,836 A * 6/1998 Bachmann ..... 52/204.51

OTHER PUBLICATIONS

"Ting Wall: A Revolution in Curtainwall Technology", Advanced Building Systems, Inc., pp. 1–10, 2000.*

"Curtainwall Window Wall Systems", 08900/YKK YCW Product Specifications, YKK AP America, Inc., Jan. 1994.*

"Ounce of Prevention", Pittsburgh Business Times, Dec. 1999.*

"1600 Wall Screw Spline Specifications", Kawneer Co., Inc., 1989.*

"Rain Screen Cladding, Air Barriers, and Curtain Walls", by Richard Keleher, The Construction Specifier, pp. 37–40, Feb. 2000.*

Wausau Guide Specifications: 5" Thermal Barrier Structural Glazed Window System: Publised annually in Sweets' Catalog 1999.

* cited by examiner

*Primary Examiner*—Carl D. Friedman
*Assistant Examiner*—Phi Dieu Tran A
(74) *Attorney, Agent, or Firm*—Henri J. A. Charmasson; John D. Buchaca

(57) ABSTRACT

A window system using air loops to completely isolate air seals from water seals. As a result of the separation of air seals from water seals, the window system can tolerate imperfect seals anywhere in the system while maintaining high resistance to water infiltration.

6 Claims, 7 Drawing Sheets

AIRLOOP WINDOW SYSTEM

FIELD OF THE INVENTION

This invention relates to the design of window systems utilizing the airloop principle to obtain high resistance to water infiltration.

DESCRIPTION OF THE PRIOR ART

A typical window system consists of a perimeter frame and at least one glass panel contained within the perimeter frame. The perimeter frame is secured to the edges of the wall opening. Each glass panel consists of a panel frame and a piece of glass secured inside the panel frame. The possible locations for water infiltration are the junctions between two adjacent window components. Sealants such as caulking or gasket are utilized at the above mentioned locations to prevent water leakage. In addition, a water drainage mechanism is provided at the bottom of the window system.

It is known in the industry that water infiltration is caused by three factors, namely, rain water running down on the exterior surface of the window system, positive differential air pressure due to wind, and imperfections in the sealant line. In the prior art systems, most of the sealant lines are used to perform two simultaneous functions, air sealing and water sealing. Perfect seals are required to prevent water infiltration. It is also known in the industry that perfect seals are extremely difficult to make and rarely last for any length of time. Therefore, first stage water infiltration within the window frame cavities is expected.

The water drainage system is provided to prevent second stage water infiltration into the building interior. However, the effectiveness of the drainage mechanism is reduced as the differential pressure increases due to the following reasons. The drainage hole is a passageway for air infiltration. The direction of air flow through the drainage hole is in the opposite direction of water drainage. Therefore, when a larger volume of air flows through the drainage hole due to a larger differential air pressure, it becomes more difficult for the water to drain out. Similarly, the degradation of sealant material due to aging may cause a larger rate of air infiltration leading to a reduction in the effectiveness of water drainage. Therefore, the watertightness of a window system is severely limited by the differential air pressure and aging.

In the case of operable windows, manufacturers normally offer a watertightness performance for a differential air pressure ranging from 6.24 psf (equivalent to a wind speed of 50 mph) to 7.5 psf when tested in accordance with ASTM E-331. In the case of fixed windows, manufacturers normally offer a watertightness performance for a differential air pressure ranging from 6.24 psf to 12 psf. Apparently, the above ranges of watertightness performance are inadequate for storm prone regions. Therefore, water leakage problems through window systems are rather common in the storm prone regions. To lessen the problem, a recessed window design is typically used to reduce the amount of water getting to the window.

SUMMARY OF THE INVENTION

The ultimate solution to the water leakage problem requires the elimination of dependency on the perfection of the sealant lines and the capacity of the drainage gutter. The objective of the present invention is to provide a window system that can tolerate imperfect seals anywhere in the system and that also can instantaneously drain any infiltrated water so that the watertightness performance can be maintained at a high positive differential air pressure.

In order to explain the working principles of this invention, the following terminologies are defined:

(1) Complex Seal: A sealant line being utilized to seal against both air infiltration and water infiltration.

(2) Air Seal: A sealant line being utilized to seal against air infiltration only (i.e. beyond the reach of water).

(3) Water Seal: A sealant line being utilized to seal against water infiltration only (i.e. pressure equalized).

From the above definitions, the following conclusions become obvious.

(1) To prevent water infiltration through a complex seal, the complex seal must be perfect.

(2) An air seal must be a dry seal located away from any possible water path in the system. Because an air seal is a dry seal, the air seal can be imperfect without causing water infiltration problem (equivalent to no rain condition).

(3) There must be near zero differential air pressure across a water seal. This means that the air space behind the water seal is pressure equalized to the exterior air pressure. Because there is near zero differential air pressure across a water seal, the water seal can be imperfect without causing water infiltration problem.

The window system of the present invention consists of a perimeter frame bordering the wall opening and at least one glass panel. A glass panel consists of a panel frame and at least one piece of window glass. In the case of multiple glass panels within a perimeter frame, a frame divider is sometimes used between two adjacent glass panels. The following locations are subjected to potential water leakage problem.

(1) Junction between the perimeter frame and the wall opening.

(2) Junction between the perimeter frame and the glass panel.

(3) Junction between two glass panels in the case of multiple glass panel system.

(4) Junction between the window glass and the panel frame or frame divider.

(5) Corners of the perimeter frame and the panel frame.

According to the present invention, pressure equalized airloops are provided along all the above-mentioned junctions to isolate the air seals from the water seals and an instantaneous drainage system is provided within the pressure equalized airloop region making water accumulation within the window system impossible. Multiple locations for air entry into the airloops are provided to eliminate the problem of high air flow rate through the water drainage holes.

The objectives of the present invention is accomplished by the airloop window system which enables the isolation of the air seals from the water seals.

Other details, objects and advantages of the present invention will become more apparent with the following description of the present invention.

BRIEF DESCRIPTION OF THE DRAWINGS

The accompanying drawings describe the present preferred invention in which.

DESCRIPTION OF THE PREFERRED EMBODIMENTS

Figure 1:
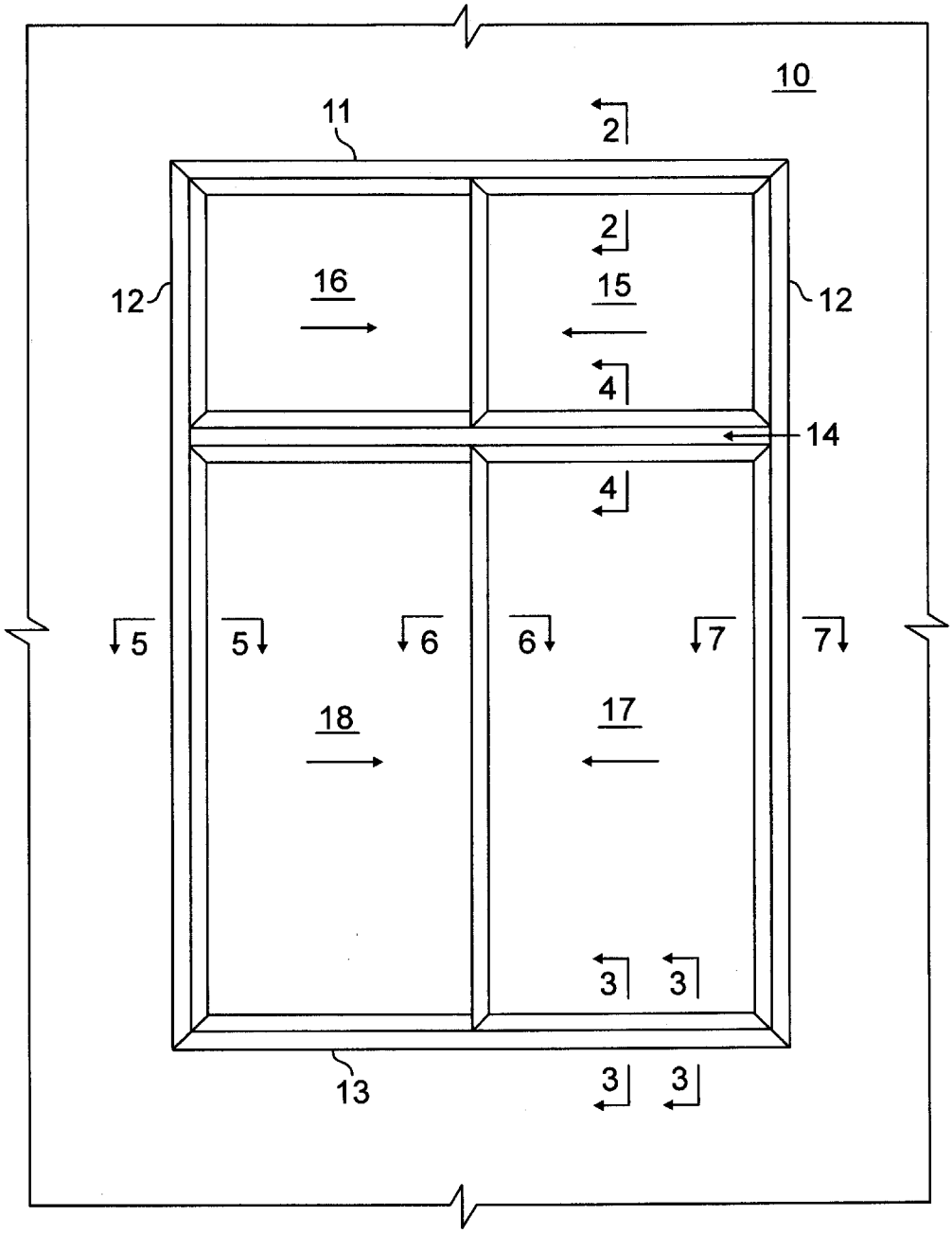
FIG. 1 is an elevation view of a horizontal sliding window system of the present invention.

FIG. 1 illustrates a sliding window unit 10 of the present invention. The perimeter frame comprises a top member 11, two jamb members 12, a bottom member 13, and a frame divider 14. The top tier of the window unit comprises two horizontally slidable glass panels 15 and 16. The bottom tier of the window unit comprises two horizontally slidable glass panels 17 and 18. It must be noted that the corners of the perimeter frame and the corners of the panel frame are mitered to allow the continuation of the air spaces within the members to form air loops such that air holes provided along one member will enable the pressure equalization of the entire air loop.

Figure 2:
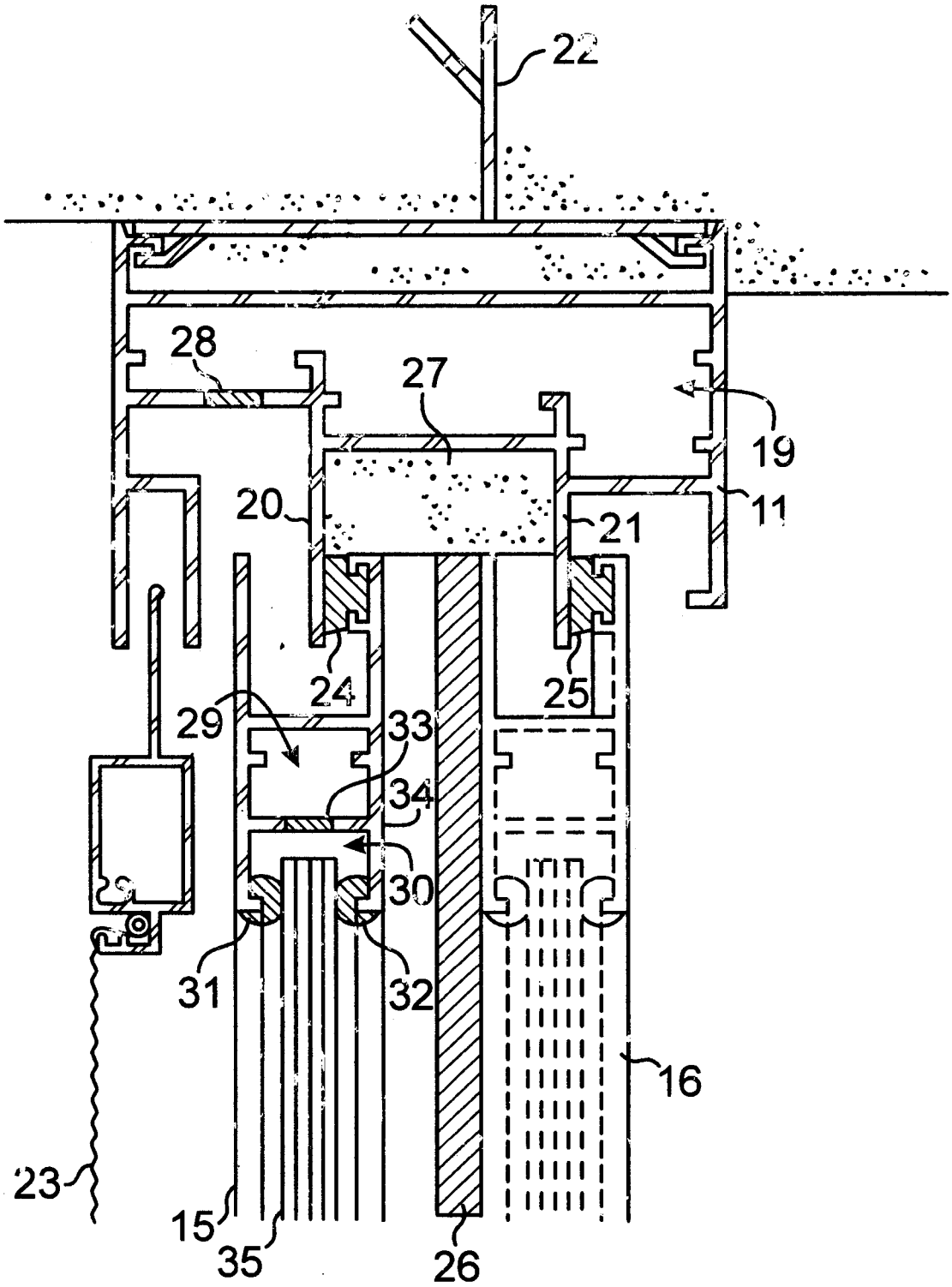
FIG. 2 is a cross-sectional view taken along line 2—2 of FIG. 1 showing the junction details at the window head.

FIG. 2 shows a cross-section at the top of the unit taken along line 2—2 of FIG. 1. The profile of the top perimeter frame member 11 defines the top segment of air loop 19, a top sliding rail 20 for the outer glass panel 15, and a top sliding rail 21 for the inner glass panel 16. The frame member 11 is anchored into the wall using the anchoring clips 22. The optional window screen panel 23 can be installed outside of the outer glass panel 15. Continuous horizontal seal 24 is provided between the top outer sliding rail 20 and the glass panel 15. Continuous horizontal seal 25 is provided between the top inner sliding rail 21 and the glass panel 16. When the window is at the closed position, vertical seal 26 is provided between the glass panels 15 and 16. Flexible soft seal block 27 is provided at the butting jamb members of panels 15 and 16 to serve as the mating seal between horizontal seal 24 and vertical seal 26. Air holes 28 are provided to allow the exterior air to enter into and pressure equalize the air loop 19. The top panel frame member 34 contains air loops 29 and 30 inter-connected by air holes 33. The air loops 29 and 30 are pressure equalized to the outside air by air holes 36 in the bottom panel frame member 37 shown in FIG. 3. Seals 24 and 25 are placed at locations that water can not be reached due to gravity. Therefore, seals 24, 25 and 27 are dry air seals that can be imperfect without causing a water infiltration problem. The glass 35 is sealed by seals 31 and 32. The seal 31 is in the path of exterior running water and is protected by the pressure equalized air loop 30. Therefore, seal 31 becomes a water seal that can be imperfect without causing a water infiltration problem. Due to the above reason, air loop 30 becomes a dry loop and seal 32 becomes an air seal that can be imperfect without causing a water infiltration problem.

Figure 3:
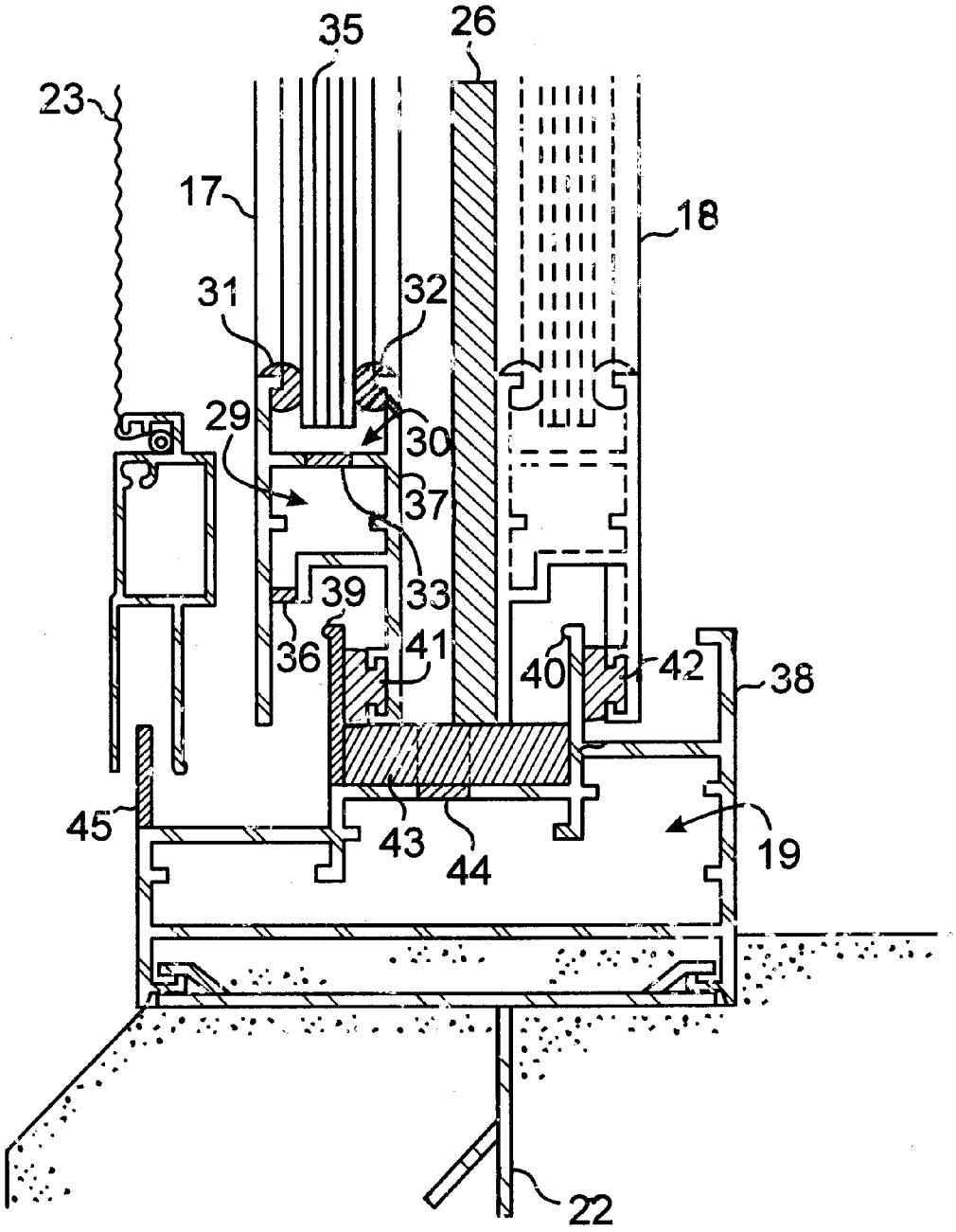
FIG. 3 is a cross-sectional view taken along line 3—3 of FIG. 1 showing the junction details at the window sill.
Figure 6:
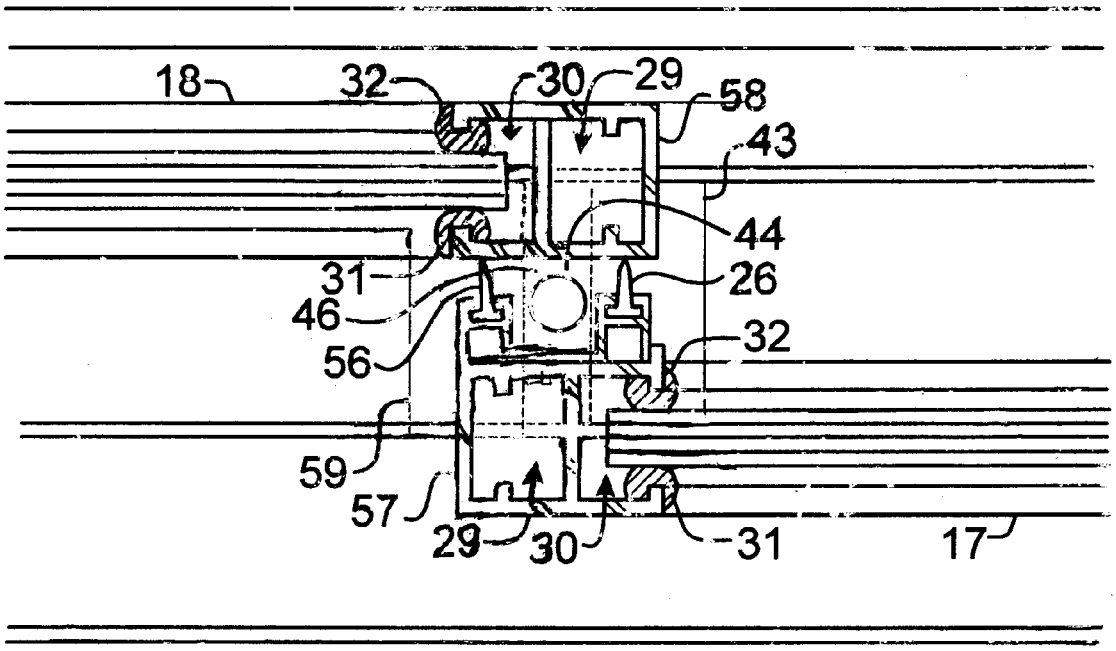
FIG. 6 is a cross-sectional view taken along line 6—6 of FIG. 1 showing the junction details at the overlapping vertical panel frame members.

FIG. 3 shows a cross-section at the bottom of the unit taken along line 3—3 of FIG. 1. The profile of the bottom perimeter frame member 38 defines the bottom segment of air loop 19, a bottom sliding rail 39 for the outer glass panel 17, and a bottom sliding rail 40 for the inner glass panel 18, and a bottom sliding rail 45 for the window screen 23. The frame member 38 is anchored into the wall using the anchoring clips 22. The optional window screen panel 23 can be installed outside of the outer glass panel 17. Continuous horizontal seal 41 is provided between the bottom outer sliding rail 39 and the glass panel 17. Continuous horizontal seal 42 is provided between the bottom inner sliding rail 40 and the glass panel 18. When the window is at the closed position, vertical seal 26 is provided between the glass panels 17 and 18. Bottom seal block 43 also shown in FIG. 6 is provided at the butting jamb members of panels 17 and 18 to serve as the mating seal between horizontal seal 41 and vertical seal 26. An air hole 44 is provided in member 38 and through seal block 43 to allow the air in the air loop 19 to enter into and pressure equalize the vertical air space 46 (shown in FIG. 6) formed between the jamb members of the butting panels 17 and 18. The bottom panel frame member 37 defines air loops 29 and 30 with air holes 36 and 33. The air loops 29 and 30 are pressure equalized to the outside air by air holes 36. The sliding rails 45, 39, and 40 serve as gutter legs for controlling and draining water. The crosshatched portion of 45 and 39 represents drain notches. It becomes apparent that seals 41 and 42 are placed at locations that water can not be reached due to the protection of 39 and 40. Therefore, seals 41 and 42 become air seals that can be imperfect without causing a water infiltration problem. As explained in FIG. 2, seal 31 is a water seal and seal 32 is an air seal that can be imperfect without causing a water infiltration problem. The bottom water control and drainage mechanism is provided by the open gutter between 45 and 39 and the segment of gutter between 39 and 40 that is open to the outside. Because the water drainage is in the exterior environment (i.e. pressure equalized condition), the water drains instantaneously preventing water accumulation.

Figure 4:
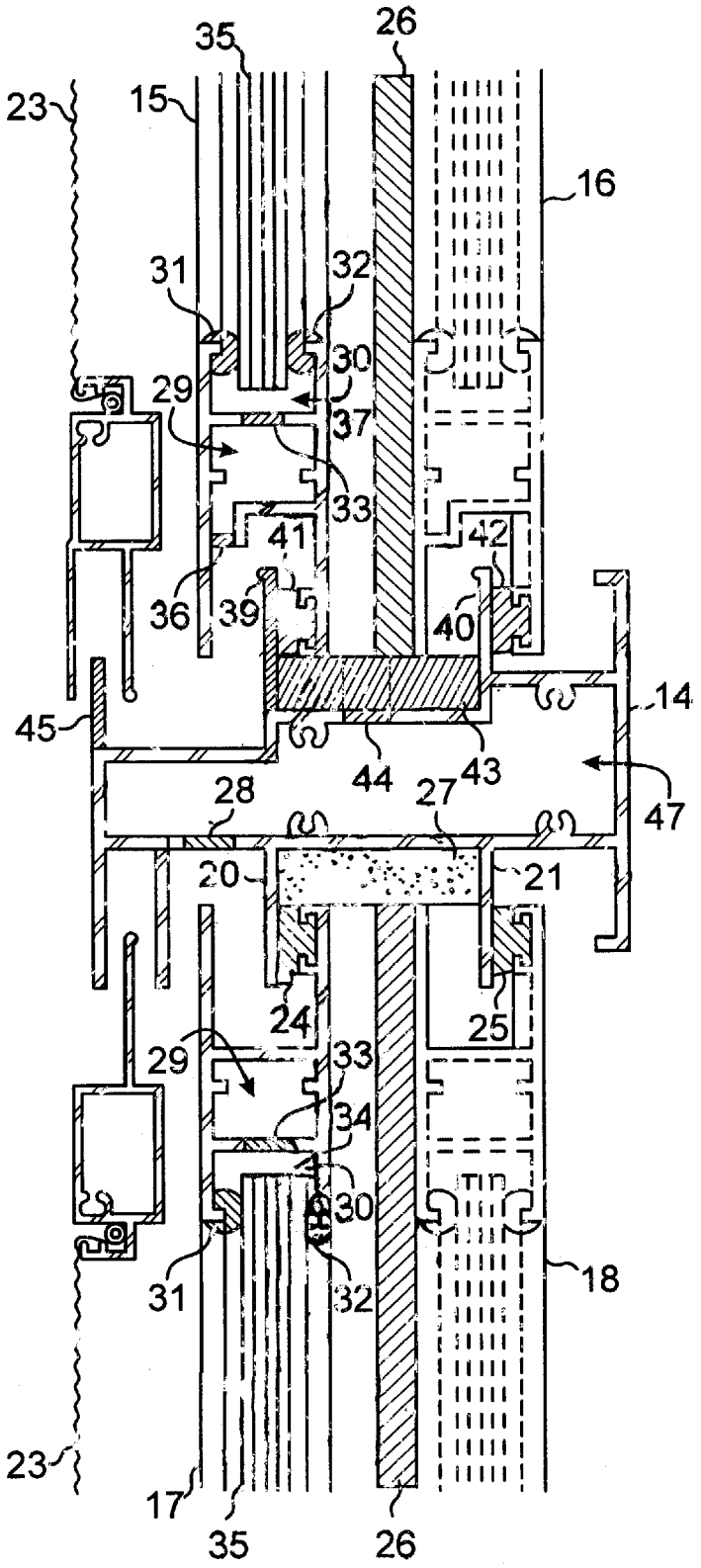
FIG. 4 is a cross-sectional view taken along line 4—4 of FIG. 1 showing the junction details at the frame divider.

FIG. 4 shows a cross-section at the frame divider 14 of the unit taken along line 4—4 of FIG. 1. The cross-section represents a typical stack joint of the window system. The sealing functions of the bottom part of FIG. 4 are the same as explained in FIG. 2 except that glass panels 15 and 16 are replaced by glass panels 17 and 18, respectively, and the air loop 19 is replaced by air space 47. Air space 47 is pressure equalized to the exterior by air holes 28. The same element numbers used in FIG. 2 for other elements are used for similar elements in the bottom part of FIG. 4 for easy reference. The sealing functions of the top part of FIG. 4 are the same as explained in FIG. 3 and the same element numbers used in FIG. 3 are used in the top part of FIG. 4 for easy reference. The frame divider 14 is optional and is not required in a single tier window system.

Figure 5:
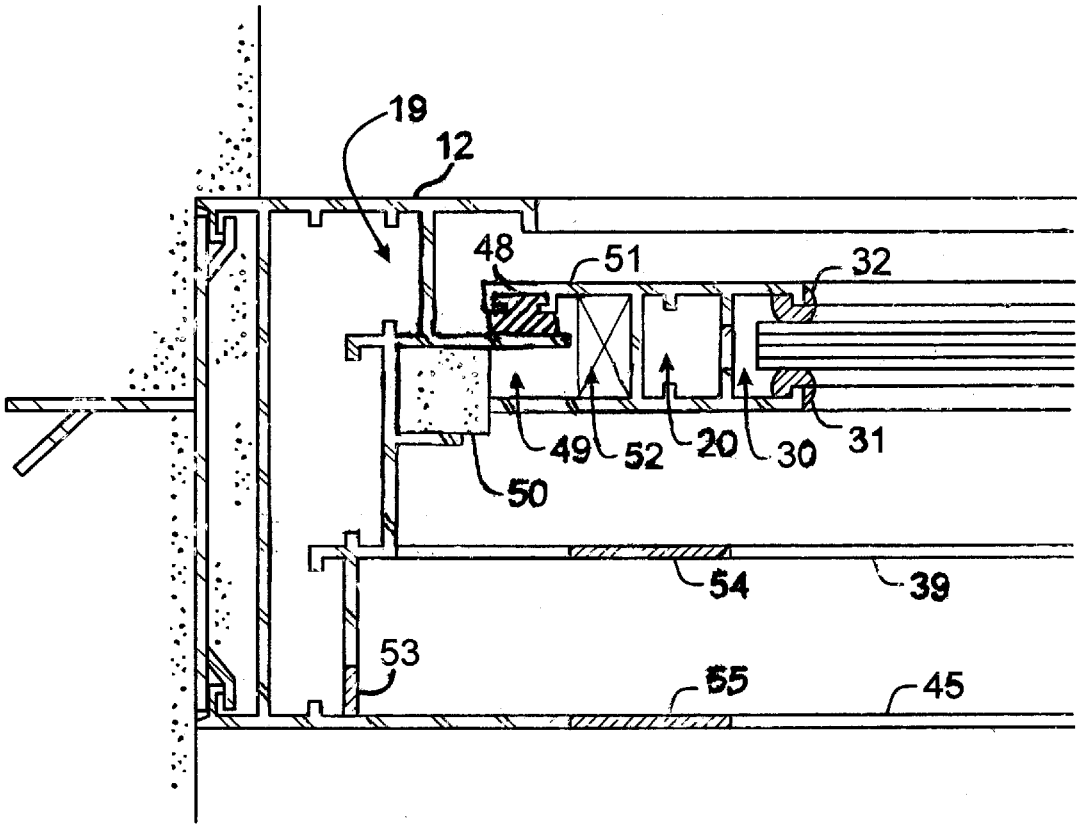
FIG. 5 is a cross-sectional view taken along line 5—5 of FIG. 1 showing the junction details at the left vertical perimeter frame member.

FIG. 5 shows a cross-section at the perimeter jamb member 12 of the unit taken along line 5—5 of FIG. 1. The cross-section shows the sealing details between the perimeter jamb member 12 and the window jamb member 51. The air loops 19, 29, and 30 as well as water seal 31 and air seal 32 are the same as explained in FIG. 2. Air holes 53 can be used to provide additional air entrances into air loop 19 or can be used to replace air holes 28 shown in FIG. 2. The air space 49 is open to the exterior air (i.e., ambient air) at the top and the bottom. Therefore, the seal 50 becomes a water seal which can tolerate imperfection without causing a water infiltration problem and the air space 49 becomes a dry air space and as a result, the seal 48 becomes an air seal which can tolerate imperfection without causing a water infiltration problem. Drain notches 54 and 55 are provided on the bottom rails 39 and 45, respectively, on the side open to the outside when the window is at the closed position. Block 52 is provided as the window side bumper.

FIG. 6 shows a cross-section at the butting panel jambs of the unit at the closed position taken along line 6—6 of FIG. 1. The glass panels 17 and 18, air loops 29, 30 and water seal 31 and air seal 32 independently applied to each panel as explained in FIG. 2 are at the closed position. The jamb member 57 of panel 17 butts with the jamb member 58 of panel 18 and seals 26 and 56 are placed in between them forming an enclosed air space 46. The top end of air space 46 is sealed off by seal block 27 shown in FIG. 4. The bottom end of air space 46 defining air hole 44 connects air space 46 to air loop 19 below and is sealed off along the sides by seal blocks 43 and 59. In this arrangement, air space 46 is pressure equalized through the connection with air loop 19. Therefore, seals 56 and 59 become water seals and seals 26 and 43 become air seals.

Figure 7:
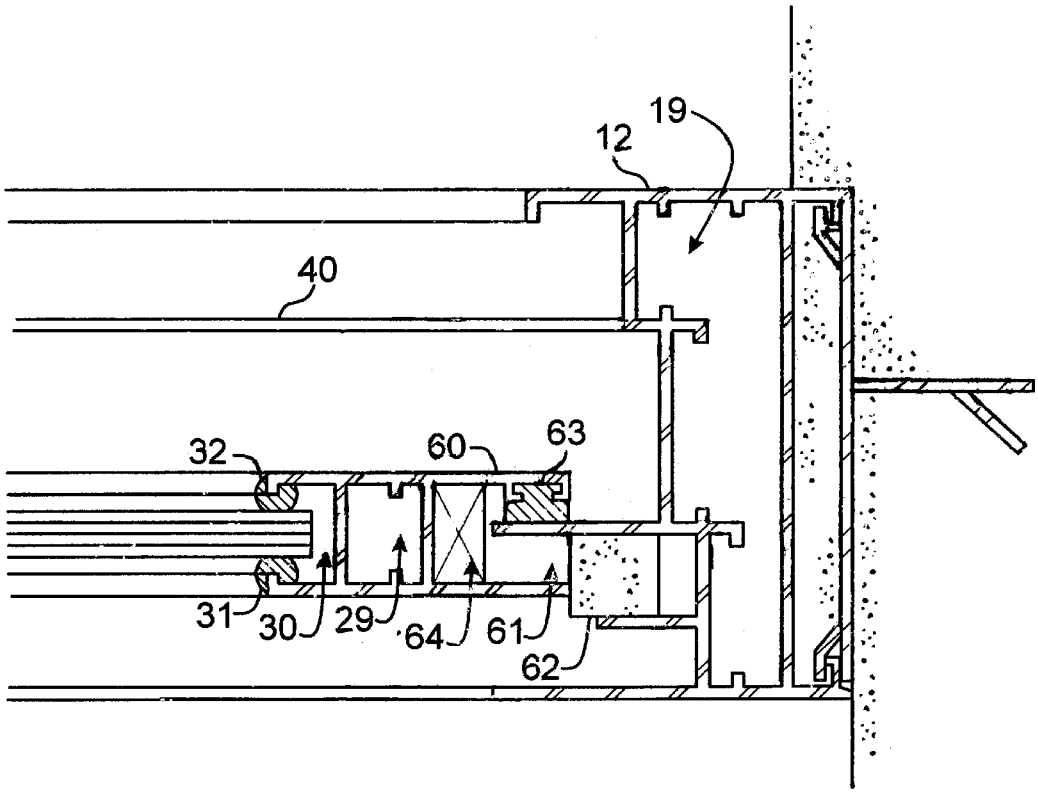
FIG. 7 is a cross-sectional view taken along line 7—7 of FIG. 1 showing the junction details at the right perimeter frame member.

FIG. 7 shows a cross-section at the perimeter jamb member 12 of the unit taken along line 7—7 of FIG. 1. The cross-section shows the sealing details between the perimeter jamb member 12 and the window jamb member 60. The air loops 19, 29, and 30 as well as water seal 31 and air seal 32 are the same as explained in FIG. 2. The air space 61 is open to the exterior air at the top and the bottom, therefore, seal 62 becomes a water seal which can tolerate imperfection without causing a water infiltration problem and the air space 61 becomes a dry air space and as a result, seal 63 becomes an air seal which can tolerate imperfection without causing a water infiltration problem. Block 64 is provided as a window jamb bumper.

In summary, the present invention utilizes pressure equalized air loops and air spaces to completely isolate air seals from water seals to accomplish the goal of achieving high resistance to water infiltration in a window system that can tolerate imperfect seals anywhere in the system. Any extrudable material such as aluminum or PVC can be used to produce the perimeter frame or panel frame members. A typical horizontally sliding window system is used in the illustrations. However, the design principles can be applied to other operable or fixed window systems.

While I have illustrated and described several embodiments of my invention, it will be understood that these are by way of illustration only and that various changes and modifications and equivalents of the present invention may be contemplated and are within the scope of the following claims.

I claim:

1. An improved window system comprising; an assembled window frame comprising, a top perimeter frame member having at least two sliding rails, a first and second perimeter frame jamb member, a bottom perimeter frame member having at least two sliding rails and a gutter, each said perimeter frame member and said perimeter frame jamb member enclosing an airspace, said bottom perimeter frame member connected to said top perimeter frame member by said first and said second perimeter frame jamb members such that each said airspace is interconnected with each other said airspace to form a first continuous airloop, said first continuous airloop pressure equalized with the external environment by at least one opening in at least one said perimeter frame member;

at least one assembled window panel comprising, a panel, an exterior water seal, an interior air seal, a top panel frame member, a first and second panel jamb member, a bottom panel frame member, each said panel frame member having a "U" shaped channel, each said panel frame member having a seal affixed thereto, said bottom panel frame member connected to said top panel frame member by said first and said second panel jamb members such that said panel frame members frame said panel, said exterior water seal contacting said panel and said panel frame member at the junction of said panel and said panel frame member, said panel frame member with each said airspace interconnected with each other said airspace to form a second continuous airloop, said second continuous airloop pressure equalized with said external environment by at least one opening in at least one said panel frame member, said "U" shaped channels associated with said panel including said exterior water seal and said interior air seal to form a third continuous airloop, said third continuous airloop pressure equalized to said external environment by at least one opening in said "U" shaped channel communicating with said second continuous airloop; and said assembled window panel installed in said assembled window frame such that one of said sliding rails of said top perimeter frame member contacts said seal affixed to said top panel frame member and one of said sliding rails of said bottom perimeter frame member contacts said seal affixed to said bottom panel frame member, wherein the improved window system also includes an outer and an inner said assembled window panel, further including a vertical seal affixed to said inner assembled window panel, wherein said bottom perimeter frame member further includes a seal block.

2. An improved window system comprising:

an assembled window frame comprising, a top perimeter frame member having at least two sliding rails, a first and second perimeter frame jamb member, a bottom perimeter frame member having at least two sliding rails and a gutter, each said perimeter frame member and said frame jamb member enclosing an airspace, said bottom perimeter frame member connected to said top perimeter frame member by said first and said second perimeter frame jamb members such that each said airspace is interconnected with each other said airspace to form a first continuous airloop, said first continuous airloop pressure equalized with the external environment by at least one opening in at least one said perimeter frame member;

at least one assembled window panel comprising, a panel, an exterior water seal, an interior air seal, a top panel frame member, a first and second panel frame jamb member, a bottom panel frame member, each said panel frame member having a "U" shaped channel, each said panel frame member having a seal affixed thereto, said bottom panel frame member connected to said top panel frame member by said first and said second panel jamb members such that said panel frame members frame said panel, said exterior water seal contacting said panel and said panel frame member at the junction of said panel and said panel frame member, said panel frame member with each said airspace interconnected with each other said airspace to form a second continuous airloop, said second continuous airloop pressure equalized with said external environment by at least one opening in at least one said panel frame member, said "U" shaped channels associated with said panel including said exterior water seal and said interior air seal to form a third continuous airloop, said third continuous airloop pressure equalized to said external environment by at least one opening in said "U" shaped channel communicating with said second continuous airloop; and said assembled window panel installed in said assembled window frame such that one of said sliding rails of said top perimeter frame member contacts said seal affixed to said top panel frame member and one of said sliding rails of said bottom perimeter frame member contacts said seal affixed to said bottom panel frame member, including a screen panel installed in said assembled window frame such that said screen panel contacts the outermost said sliding rail of said top perimeter frame member and said screen panel contacts the outermost said sliding rail of said bottom perimeter frame member.

3. A perimeter frame system for framing a panel that substantially separates an exterior environment from a building interior environment, said panel frame system comprising:

a) a top member;

b) a first and a second jamb member; and c) a bottom member connected to said top member by said first and second jamb members, wherein portions of each of said members form a portion of an air passageway and wherein said air passageways form an interconnected airloop substantially around said panel, and wherein at least one of said members has an air opening from said air passageway to said exterior environment and gutter legs and a gutter space located proximate to an air path between said air opening and said exterior environment and which also comprises an imperfect water seal located between said panel and said members wherein said air opening is located in said bottom member such that water leaking past said imperfect water seal can drain through said air opening and air can enter to substantially equalize the air pressure between said airloop and said exterior environment.

4. The perimeter frame system of claim 3 which also comprises an imperfect air seal located proximate to said panel such that water leaking past said imperfect water seal can drain and air can enter to equalize the air pressure between said airloop and said exterior environment and can enter to make up for air leaking past said imperfect seal.

5. The perimeter frame system of claim 4 wherein said air opening comprises a plurality of air openings.

6. The perimeter frame system of claim 4 wherein said water leaking past said imperfect water seal can drain through said air opening and be temporarily retained in said gutter space while air can enter to substantially equalize the air pressure between said airloop and said exterior environment.

* * * * *